United States Patent [19]

Whittingham et al.

[11] 4,442,741

[45] Apr. 17, 1984

[54] MEAT LOG CUTTER

[76] Inventors: Thomas D. Whittingham, 1127 N. Chester Rd., West Chester, Pa. 19380; William G. Hennig, 2146 Toluka Way, Boise, Id. 83702; Thomas A. Brahler, 119 Governor Ct., Downingtown, Pa. 19335

[21] Appl. No.: 415,269

[22] Filed: Sep. 7, 1982

[51] Int. Cl.[3] ..... B26D 5/38

[52] U.S. Cl. ..... 83/80; 83/110; 83/370; 83/578; 83/651.1

[58] Field of Search ..... 83/80, 79, 110, 112, 83/365, 370, 372, 578, 651.1

[56] References Cited

U.S. PATENT DOCUMENTS 3,011,375 12/1951 Muller ..... 83/372 X 4,258,599 3/1981 Keck ..... 83/112

4,369,683 1/1983 Bieg ..... 83/79 X

*Primary Examiner*—James M. Meister

[57] ABSTRACT

An automatic meat log cutter for cutting continuous extrusions of minced meat to logs of preselected length comprises a photocell located at a preselected distance from the discharge end of the extruder for sensing the arrival of the front end of the extrusion and in response thereto for triggering the operation of a solenoid-actuated air-cylinder for driving a music wire cutter transversely through the extrusion at a point immediately in front of the extruder and for simultaneously speeding up the travel speed of the conveyor to create a spaced distance between the rearward end of the log and the front end of the extrusion. For successive logs, the cutting stroke is alternately downward and upward.

10 Claims, 9 Drawing Figures

MEAT LOG CUTTER

BACKGROUND OF THE INVENTION

This invention relates to a mechanism for cutting meat logs. Meat logs are formed by extruding finely divided or minced meat and cutting the extrusion into logs of preselected length, as for example, 18". The extrusion, and the logs which are severed therefrom, are preferably rectangular in cross section, as for example, 4"×7".

SUMMARY OF THE INVENTION

A principal object of the present invention is to provide an improved mechanism for cutting the continuous extrusion of finely divided meat into logs of preselected length.

Another object is to provide a mechanism which will produce meat logs of uniform length from an extrusion, and which eliminates manual cutting.

Yet another object is to provide a mechanism for automatically cutting a meat-mixture extrusion into logs of uniform length and which will automatically space the logs apart to permit manual overwrapping with polyfilm and placement of the logs in molded boxes for freezing.

DETAILED DESCRIPTION OF THE PREFERRED EMBODIMENTS

Figure 1:
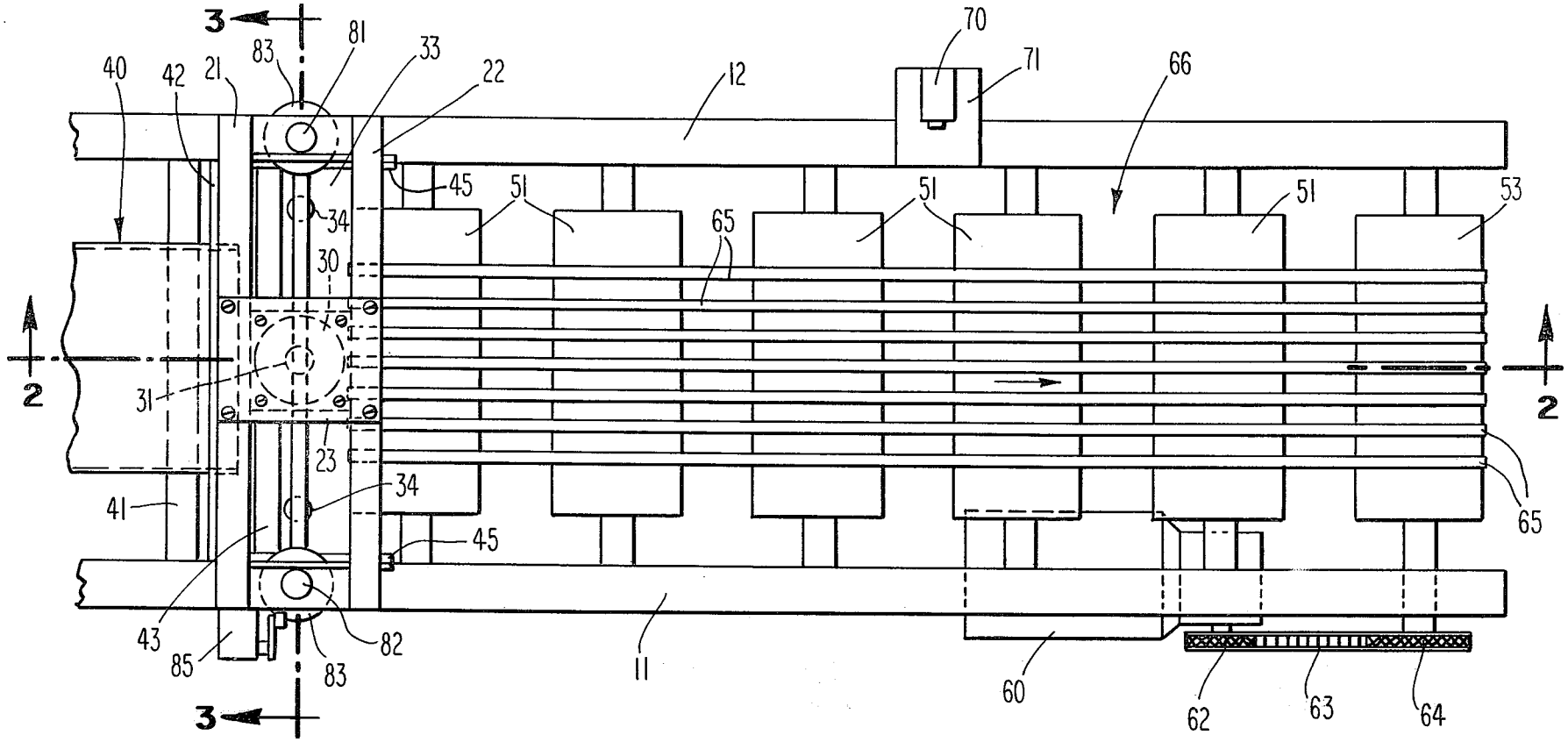
FIG. 1 is a plan view of the log cutting mechanism according to the present invention.
Figure 2:
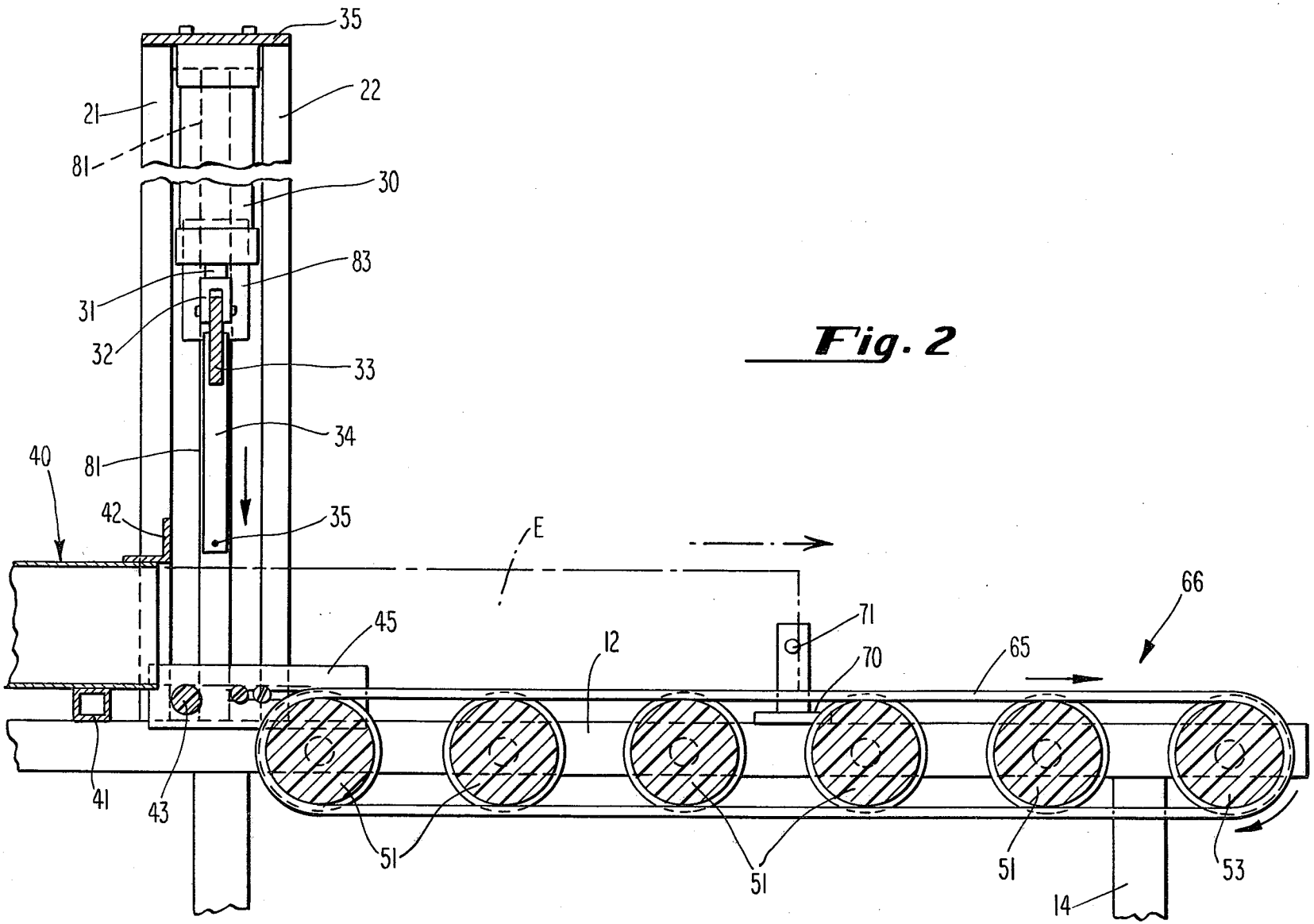
FIG. 2 is a side view looking along the line 2—2 of FIG. 1.
Figure 3:
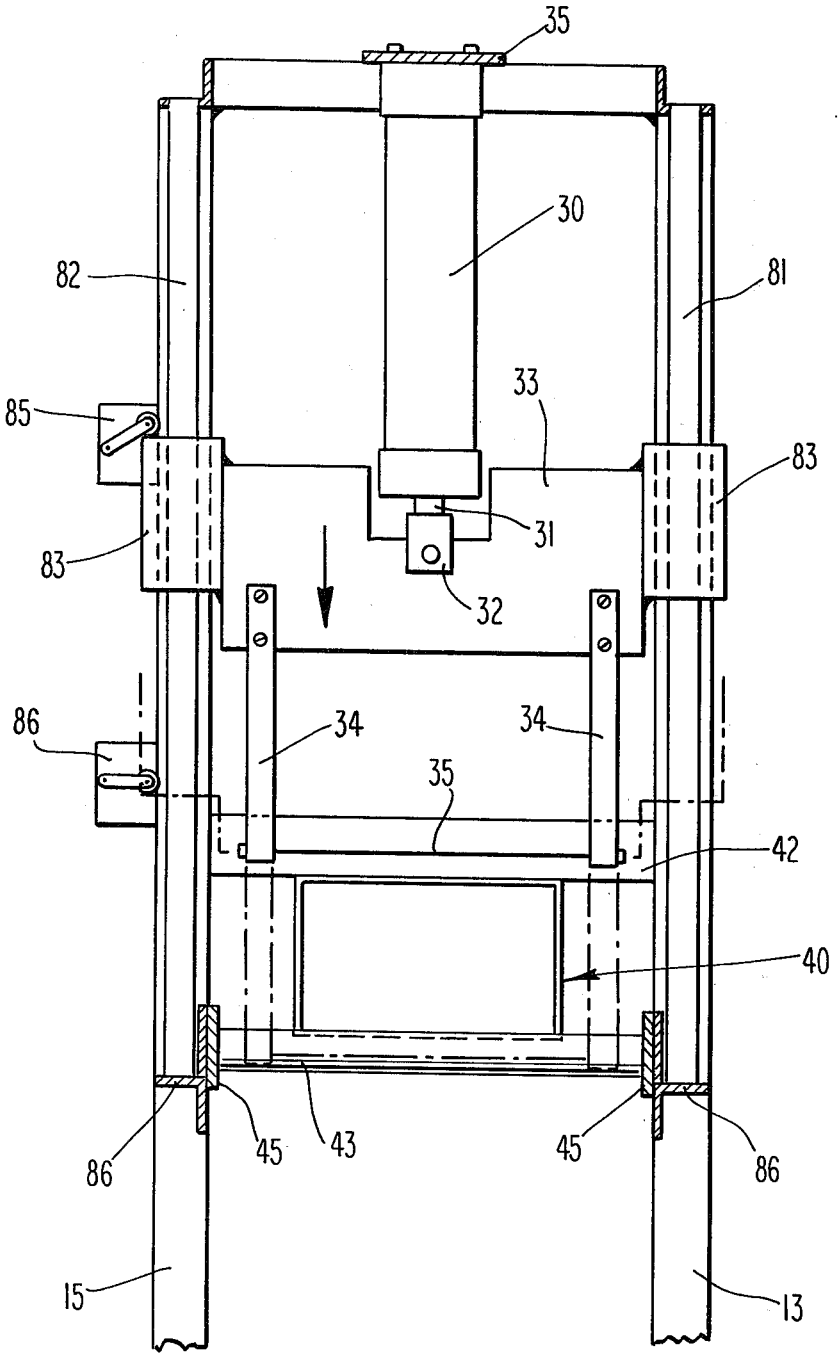
FIG. 3 is a view in elevation looking along the line 3—3 of FIG. 1.

Referring to FIGS. 1-3, the discharge end of an extruder 40 faces a conveyor 66 comprising a plurality of individual endless belts 65. Seven belts are shown in the illustrated machine.

The conveyor belts 65 are trained about six rolls. Five of the rolls, identified 51, are idler rolls. The sixth roll 53 is driven by an electric motor 60, as by a chain and sprocket drive comprising sprockets 62 and 64 and chain 63.

For a purpose to be described later, the conveyor motor 60 is adapted to be driven at two different speeds, one of which will drive the individual conveyor belts at a speed in the range of 40-80 feet per minute and the other of which will drive the belts at a speed in the range of 90 to 100 feet per minute. The shafts of the conveyor rollers are supported in the frame of the machine, specifically in side members 11 and 12. These side members are shown to be supported on four legss, three of which identified 13, 14 and 15 are seen in the drawing; the fourth leg is not visible.

Located between the discharge end of the extruder 40 and the receiving or input end of the conveyor 66 is a cutting mechanism for severing the extruded. The cutter itself is a wire identified 35, preferably a No. 40 music wire, which as best seen in FIG. 3, is stretched between and supported by two hangers 34 which are supported by, and depend from, a slide plate 33 having at each end a bushing or bearing 83 adapted to ride up and down on bearing rods 81 which are supported on angle members 86.

Slide plate 33 is connected, as by a forked connecting member 32, to the end of a piston rod 31 driven by a solenoid-actuated double-acting air cylinder 30. Air cylinder 30 is supported from a plate 35 which in turn is supported at the upper end of a pair of vertical frame plates 21 and 22, which are supported on, and extend upwardly from, the frame side members 11 and 12. Immediately in front of the discharge end of the extruder 40 is a support roller 43 for supporting the extruded meat as it emerges from the extruder. Support roller 43 extends between two side plates 45 (FIG. 3) whose positions are vertically adjustable so that the position of the support roller 43 may be adjusted. Preferably roller 43 is adjusted to such a position that the upper surface of the roller is slightly above the upper surface of the conveyor belts 65. The cutter mechanism is so located that the cutter wire 35 severs the meat log immediately beyond the support roller 43.

Reference is now made to FIGS. 4A through 4E which comprise a series of diagrammatic illustrations to show the operation of the meat log cutter according to the present invention.

Figure 4:
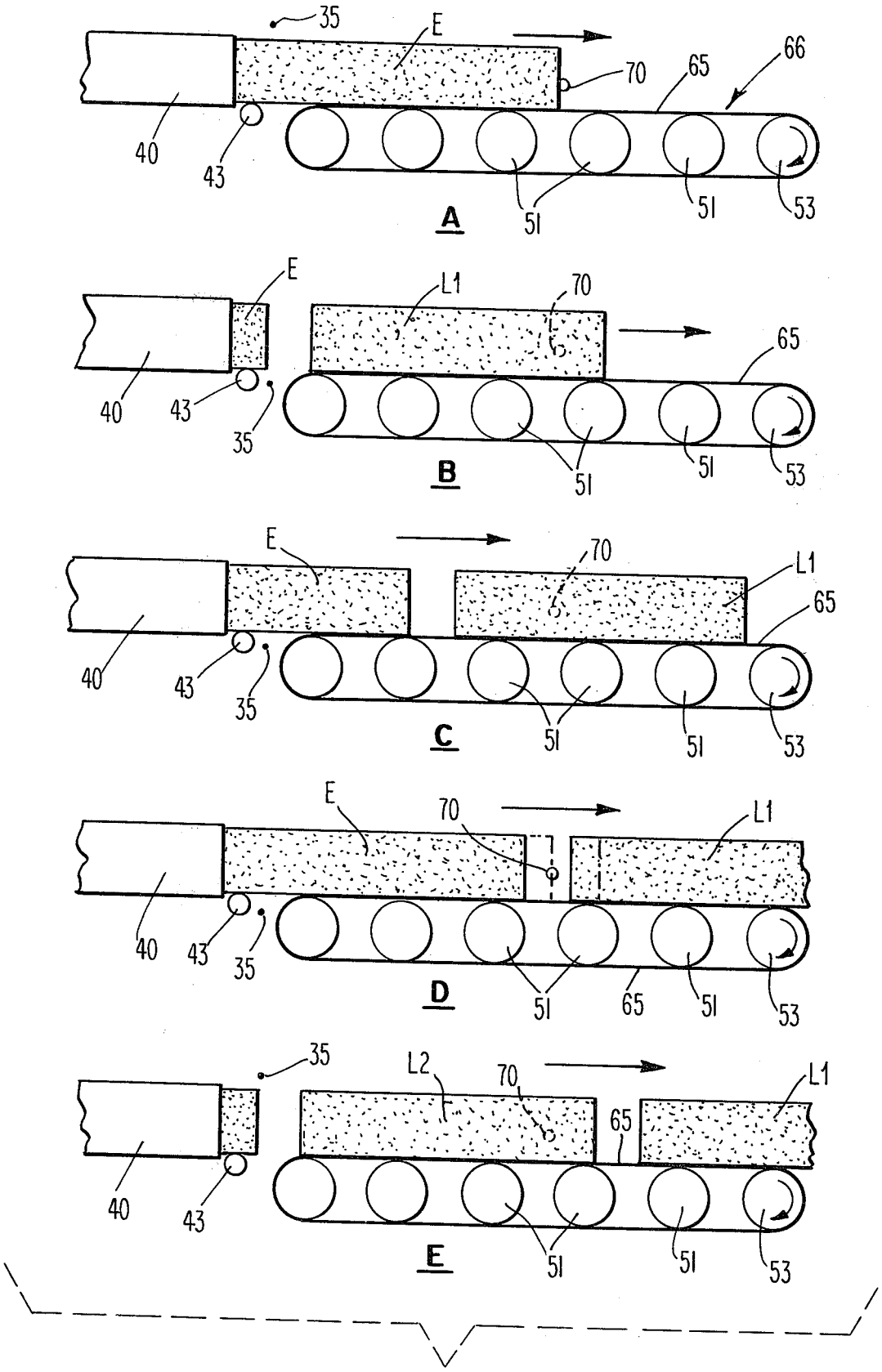
FIGS. 4A through 4E are a series of diagramatic illustrations showing the manner in which the logs are cut from the extrusion.

In FIG. 4A the extrusion E of meat material which, as previously noted, is preferably of rectangular cross section, typically 4"×7", has just reached and is about to block the light beam from reaching the photo-electric cell 70 which is located at a preselected distance from the discharge end of extruder 40. When the light beam is blocked, the photo-cell actuates electric circuit means, which will be described later, which cause the air-cylinder solenoid to be energized. As a result, the piston 31 of air cylinder 30 is extended and cutter wire 35 is driven downwardly through the meat material, thereby severing the extrusion and forming log L1, as illustrated in FIG. 4B. The down stroke through the meat is very fast and requires only between one to five milliseconds. At the same time, in response to the blocking of the light beam by the extruded meat material, photocell 70 causes drive motor 60 of the belt conveyor to be stepped up in speed thereby causing the conveyor belts 65 to "jump" forwardly, thereby creating a spaced distance between the severed rearward end of the meat log L1 and the forward end of the extrusion E. This is illustrated in FIGS. 4B and 4C.

When log L1 passes beyond photocell 70, as seen in FIG. 4D, light from the beam again reaches the photocell 70 and in response thereto the photocell operates electric circuitry to reset the system. Shortly thereafter, the front of the extrusion E again reaches photocell 70, as is illustrated in FIG. 4D in dotted lines. When the light beam is again blocked from photocell 70, the photocell activates electric circuitry which energized the solenoid of the double-acting air cylinder 30, and the piston 31 is retracted rapidly. Thus, cutter wire 35 is pulled rapidly upwardly through the meat extrusion to sever the extrusion, thereby to form log L2, as is illustrated in FIG. 4E. At the same time, the speed of motor 60 of conveyor 60 is again speeded up to create a spaced distance between the severed rearward end of log L2 and the front end of extrusion E. This is illustrated in FIG. 4E.

To summarize the operation illustrated in FIGS. 4A-4E, a photocell located at a preselected distance from the discharge end of the meat extruder senses the arrival of the forward end of the extrusion and activates a double acting air cylinder which drives a music wire cutter through the extruder meat material. The cutting action is alternately one stroke down to sever the extrusion, and then after further extrusion, an upward stroke to again sever the extrusion. The cutting stroke is very fast, and takes place in between 1 and 5 milliseconds, preferably about 1 millisecond. This cutting speed is sufficiently fast that the cut is straight down or straight up, with no bias. At the same time that the photocell activates the cutter, it also causes the motor drive for the conveyor belt to be speeded up to cause the severed log to jump ahead, thereby creating a space between the log just severed and the remainder of the extrusion.

Figure 5:
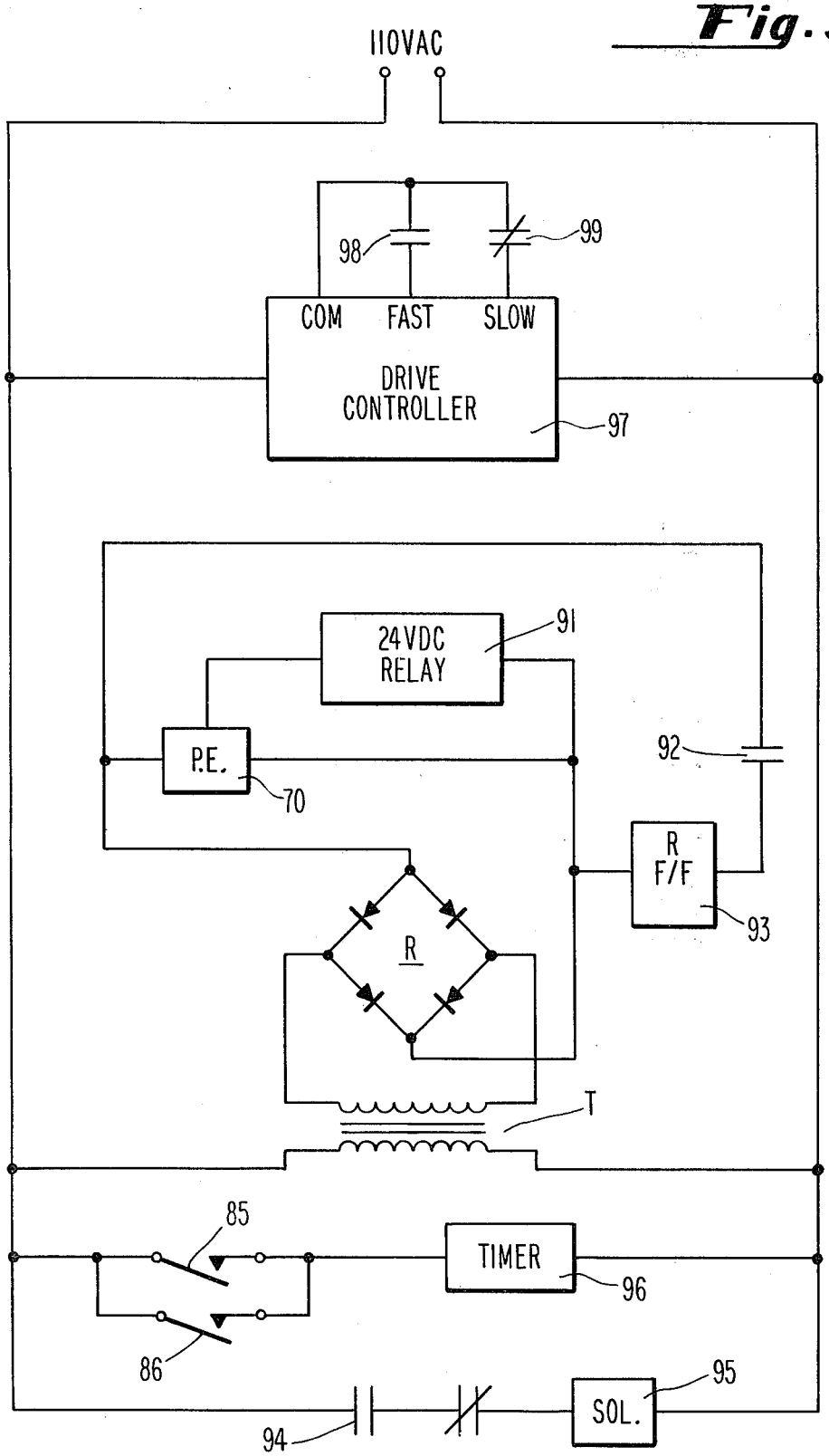
FIG. 5 is a diagram of the electrical circuitry.

FIG. 5 shows an electric circuit which may be used to control the operation of the meat log cutter of the present invention.

The 110-volt line voltage is stepped down by transformer T, rectified by full-wave rectifier R, and applied as a DC voltage across the photoelectric cell 70. So long as the photo-cell 70 receives light from the light beam, it is energized and effectively shorts out the 24-volt DC relay 91. When the forward end of the meat extrusion E intercepts the light beam, relay 91 is actuated and its contacts 92 close. As a result, the rectified voltage is applied across the flip-flop relay 93, and contacts 94 of the relay 93 close. This places line voltage across the solenoid 95 of the air cylinder 30 and causes the air cylinder to extend or retract its piston rod 31. For the purpose of this description it will be assumed that piston rod 31 had been in retracted position and that energization of solenoid 95 causes the piston rod 31 to be extended. This lowers slide plate 33 and cutter blade 35. When slide plate 33 reaches the bottom of its stroke, it actuates and closes the normally-open bottom limit switch 86. The closing of bottom limit switch 86 completes a circuit through the time delay relay 96. Timer 96 controls the SCR drive controller 97 and closes contacts 98. This steps up for a short period of time the voltage applied to drive motor 60 of belt conveyor 66, thereby to speed up for a short period of time the travel speed of the conveyor.

The time delay relay 96 and flip-flop relay 93 are commercial products which are available from AMF Corporation. The time delay relay provides a time delay of from 1 to 10 seconds. The drive controller 97 is also a commercially available product. It is a variable DC drive controller known as a Wood's Controller, available from TB Wood's Sons Company, Chambersburg, Pa. The drive controller 97 and the time delay relay 96, in response to the closing of one of the limit switches 85 or 86 are effective to apply, for a selected interval of time rangeing from 1 to 10 seconds, an increased voltage to the electric drive motor 60 of the belt conveyor 66. At the end of the selected time period, the voltage to the conveyor motor reduces to its lower normal value.

What is claimed is:

1. In cooperative association with a minced meat extruder having motor driven discharge conveyor means extending forwardly from the discharge end of the extruder, a cutting mechanism between the discharge end of the extruder and the conveyor for cutting continuous extrusions of minced meat into logs of preselected length, said cutting mechanism comprising:

a. a double-acting fluid cylinder having a piston;

b. support means for supporting the fluid cylinder and piston in vertical position above the discharge end of the extruder;

c. a cutter;

d. means connecting the end of the piston to the cutter;

e. sensing means positioned along the discharge conveyor at a preselected distance from the discharge end of the extruder for sensing the arrival of the front end of the meat extrusion;

f. means responsive to the sensing of the arrival of the front end of the extrusion at said sensing means location for actuating said fluid cylinder to drive the cutter transversely through the meat extrusion to form a meat log; and g. means responsive to the sensing of the arrival of the front end of the extrusion at said sensing means location for speeding up the travel speed of the conveyor means to create a spaced distance between the severed rearward end of the meat log and the forward end of the meat extrusion.

2. Apparatus according to claim 1 wherein said means responsive to said sensing means is effective alternately to actuate said fluid cylinder to drive said cutter downwardly through said meat extrusion to form a meat log, and subsequently to drive said cutter upwardly through said meat extrusion to form a succeeding meat log.

3. Apparatus according to claim 1 wherein said sensing means includes a photo-electric cell.

4. Apparatus according to claim 1 wherein said means responsive to said sensing means for speeding up the travel speed of said conveyor means comprises and electric motor and means for increasing the voltage applied to said motor.

5. Apparatus according to claim 1 wherein said cutter is a wire.

6. Apparatus according to claim 1 wherein a support roller for said extrusion is provided between the discharge end of said extruder and said conveyor means.

7. Apparatus according to claim 6 wherein said cutter is located between said support roller and said conveyor means.

8. Apparatus according to claim 5 wherein the wire cutter is driven through said meat extrusion in 1–5 milliseconds.

9. Apparatus according to claim 8 wherein, in response to said sensing means, the travel speed of said conveyor means is speeded up from 40–80 feet per minute to 90–100 feet per minute.

10. Apparatus according to claim 1 wherein said fluid cylinder is an air cylinder.

* * * * *